United States Patent [19]

Cillario

[11] 4,339,033

[45] Jul. 13, 1982

[54] PACK FOR CONFECTIONERY PRODUCTS

[75] Inventor: Lorenzo Cillario, Alba, Italy

[73] Assignee: Ferrero S.p.A., Alba, Italy

[21] Appl. No.: 211,539

[22] Filed: Nov. 26, 1980

[30] Foreign Application Priority Data

Jan. 10, 1980 [IT] Italy ..... 52820/80[U]

[51] Int. Cl.[3] ..... B65D 85/62

[52] U.S. Cl. ..... 206/216; 206/562; 220/23.4; 229/1.5 C

[58] Field of Search ..... 206/216, 219, 220, 562; 220/23.4, 23.8; 229/1.5 C

[56] References Cited

U.S. PATENT DOCUMENTS

| | | | |
|---|---|---|---|
| 2,469,343 | 5/1949 | Siewert | 229/1.5 C |
| 2,475,294 | 7/1949 | Rafoth | 229/1.5 C |
| 2,981,039 | 4/1961 | Pohl | 206/562 X |
| 3,184,319 | 5/1965 | Fritsche | 206/216 X |
| 4,054,207 | 10/1977 | Lazure et al. | 220/23.4 X |

*Primary Examiner*—Steven M. Pollard

*Attorney, Agent, or Firm*—Bernard, Rothwell & Brown

[57] ABSTRACT

A pack for two different unwrapped confectionery products comprises two pots closed by a seal and each provided around its mouth with a flange which is stuck to the edge of a corresponding aperture in a support plate. An adhesive label is stuck over the plate and the seals of the two pots. The label has an appendage which can be torn off and to which there is adhered a flexible container for a small spoon.

The pack enables the user to take up portions of the two products from their respective pots with ease while holding the pot in one hand.

12 Claims, 5 Drawing Figures

PACK FOR CONFECTIONERY PRODUCTS

The present invention relates to a pack for confectionery products.

The object of the invention is to provide a pack which is intended to contain, in separate receptacles, two different food products in unwrapped form for simultaneous consumption, and which enables the user to readily take up portions of the said two products from their respective receptacles whilst he holds the pack in his hand.

Forms of packaging are known for creamy products, such as yoghourt, in which a number of containers are held together by a flexible supporting sheet connected to the tops of the containers.

These known types of packaging are only intended to facilitate the storage and distribution of the containers and, when in use, require that a container which is about to be consumed is torn off from the remaining containers; these types of packaging are therefore unsuitable for achieving the object of the present invention.

In order to achieve the aforesaid object, the present invention provides a pack for confectionery products characterised in that it comprises in combination:

- a support plate provided with two apertures,
- two pots inserted in the two apertures of the support plate and containing two different types of product, each pot having, in correspondence with its mouth, a peripheral flange which rests on the support plate, the mouth of each pot being closed by a seal of sheet material;
- an adhesive label which has profile corresponding to the outline of the support plate and is applied to this plate in such a manner as to adhere both to the plate and to the seals of the two pots;
- a tongue extending from one portion of the boundary of the adhesive label, this tongue having an adhesive face and being separable from the label by tearing;
- a flexible flat container which may be torn open and contains a small spoon; this container being carried by the said tongue due to adhesion between the adhesive face of the tongue and one of the faces of the container.

Preferably the tongue is formed in a single piece with the adhesive label and a series of aligned perforations is provided between the boundary of the label and the tongue so that the tongue, with the spoon container attached thereto, may be torn off from the label.

The pack which is the subject of the present invention is particularly useful when one of the two pots contains a creamy product, preferably a milk-based cream, and the other contains a granular solid product, preferably puffed cereals, intended to be consumed at the same time as the creamy product.

In this case, the user when about to eat, can readily separate the spoon container from the pack by tearing off the tongue attached to this container from the label of the pack. Moreover, separation of the label from the container gives access to the two seals which close the mouths of the two pots so that the user may, by tearing open the spoon container, use the spoon to rip open the seals of the two containers and take up a portion of cream from one of the containers and then take up a portion of puffed cereal by dipping the spoon with the cream portion into the other container.

Further characteristics and advantages of the present invention will become apparent from the description which follows with reference to the appended drawings, given by way of non-limiting example, in which.

Figure 1:
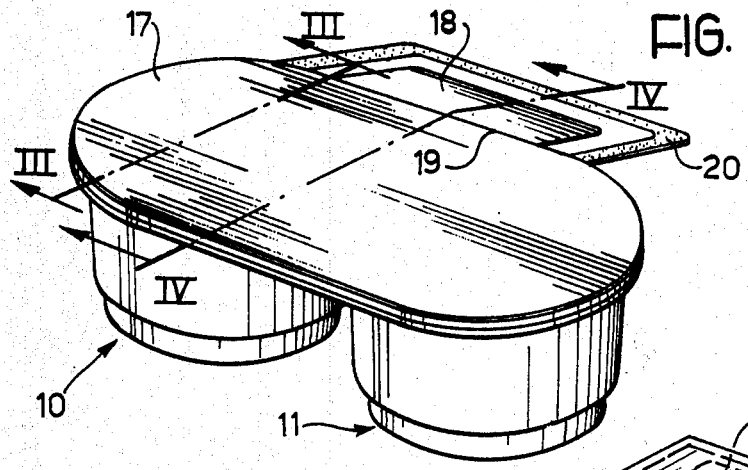
FIG. 1 is a perspective view of the pack.
Figure 2:
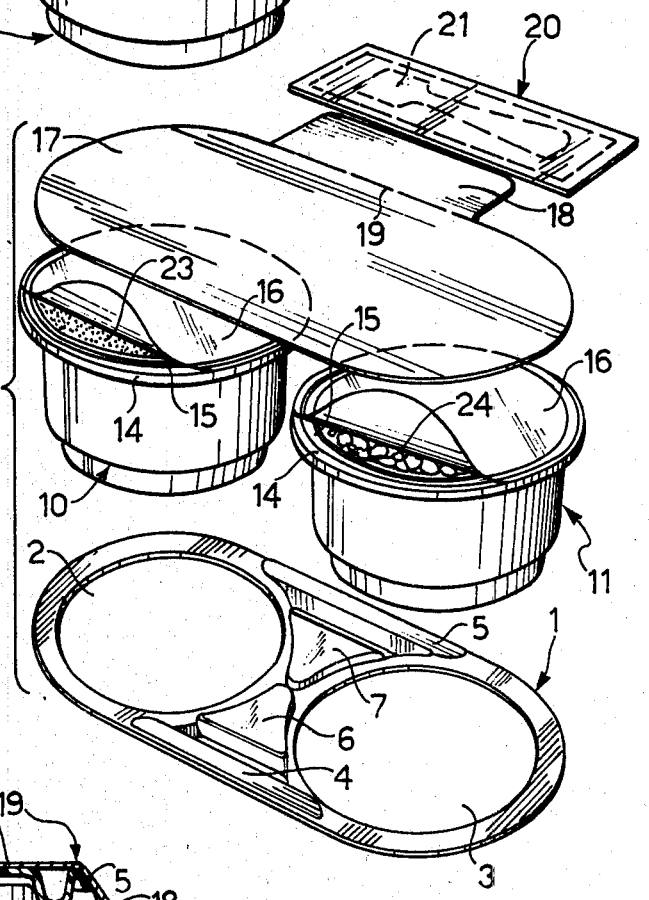
FIG. 2 is an exploded view of the pack illustrated in FIG. 1.
Figure 4:
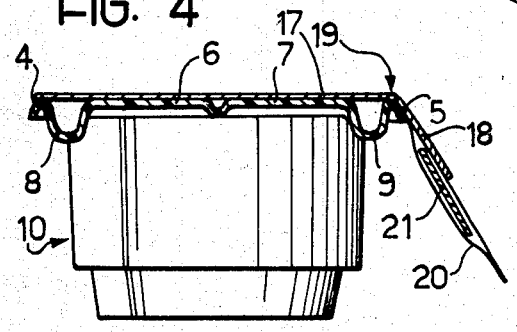
FIG. 4 is a cross section to an enlarged scale taken along line IV—IV of FIG. 1.

The pack illustrated in the drawings comprises a support plate 1 of elongate form which has an outline made up of two straightline sides connected by two semicircular sections.

The plate is provided with two circular apertures 2, 3 which have the same centre of curvature as the semicircular sections of its outline.

In the area between the apertures 2 and 3, the plate 1 has two longitudinal ribs 4, 5 adjacent to the two straightline sections of its outline, and two central ribs 6, 7 of a substantially triangular profile. Each of the ribs 6 and 7 has two curved sides which have the same centre of curvature as the apertures 2, 3. The top of the ribs 4, 5, 6 and 7 all lie in the same plane parallel to the plane of plate 1.

Between the ribs 4 and 6, the plate 1 has a longitudinal depression which results in the formation of a rib 8 on the underside of the plate.

A similar longitudinal rib 9 is comprised between the ribs 5 and 7.

Two pots of heat moulded plastic material are indicated by references 10 and 11.

Figure 3:
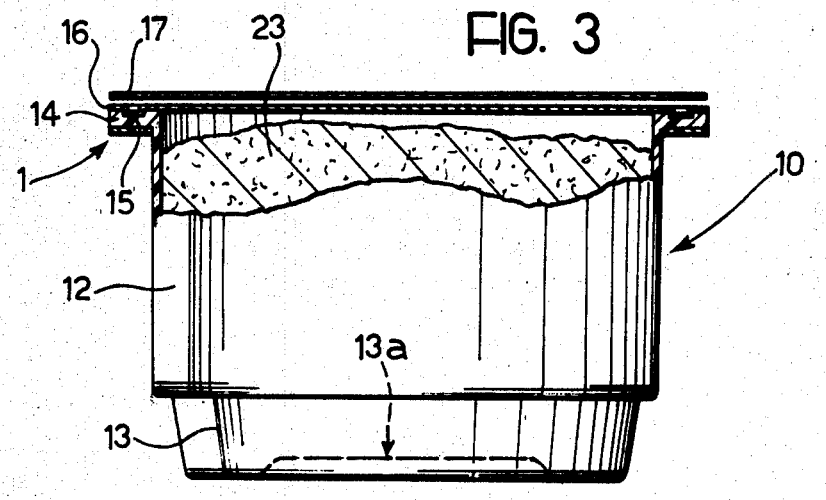
FIG. 3 is a section to an enlarged scale taken along line III—III of FIG. 1.
Figure 5:
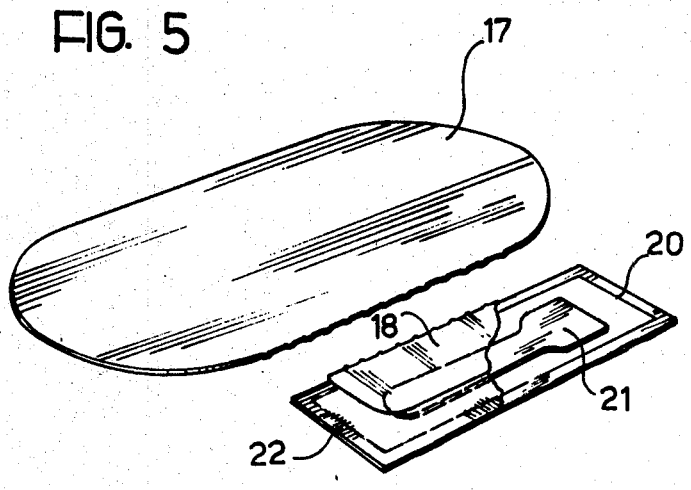
FIG. 5 is a detail illustrating the separation, from the container label, of the tongue to which the spoon container is attached.

As shown in FIG. 3, each pot has a cylindrical side wall 12 of substantially the same diameter as the circular apertures 2 and 3, a lower frusto-conical part 13 the bottom of which is centrally raised as shown at 13*a*, and a flange 14 associated with its upper mouth.

The flange 14 of each pot 10, 11 is provided on its upper face with an annular groove 15.

The mouth of each pot is closed by a seal formed by a disc 16 of soft aluminium foil which is stuck to the upper face of flange 14 in such a manner that it also adheres to the walls of the annular groove 15 of this flange to produce a sealed closure.

The flange 14 of each of the pots 10, 11 rests on the support plate 1 which thus serves as a support for the two pots.

Preferably the flange of each of the containers 10, 11 is joined to the support plate 1 by means of spots of glue positioned, for example, at two diametrally opposite points.

An adhesive label 17 with a profile corresponding to the outline of the support plate 1, is stuck over both the seals 16 of the two pots and the ribs 4, 5, 6 and 7 of the plate, the tops of these ribs being in the same plane as the two seals 16.

Along one of its straight sides, the label 17 has an appendage in the form of a tongue 18, the front face of which is adhesive like label 17.

A series of aligned perforations 19 is provided along the boundary between the label 17 and the tongue 18 and these perforations form a line of separation for the tongue 18 to be torn off from the label 17.

The adhesive face of the tongue 18 is applied onto one of the faces of a flexible container 20 which contains a small spoon 21 of plastics material. The border of the flat flexible container 20 is provided impressions 22 which enable it to be torn open with ease.

One of the two pots, the pot 10 in the example shown, is filled with a milk-based creamy product 23 whilst the other pot 11 is filled with mixed puffed cereal 24 (rice, barley, wheat, maize).

When about to eat, the user removes the adhesive label 17 from the pack and separates the tongue 18, with the container 20 attached thereto, from the label 17 by tearing along the line of perforations 19. The user then proceeds to open the flat container 20, by tearing around its border 22, in order to lift out the spoon 21.

With the aid of the spoon 21, the user can rip open the seals 16 which close the two pots 10 and 11 and, using the same spoon 21, consume the products contained therein.

In practice the user takes up a little cream 23 from the pot 10 and then immerses the spoon 21 coated with the cream into pot 11 so that a portion of puffed cereal 24 is taken up adhering to the cream on the spoon.

I claim:

1. A pack for confectionery products, comprising:

a support plate formed to define two apertures therein;

two pots inserted in respective ones of the said two apertures of the support plate and containing two different types of product, each pot having a mouth and being formed in correspondence therewith with a peripheral flange which rests on said support plate, each said pot being further provided with a seal of sheet material closing off the mouth of the pot;

an adhesive label which has a profile corresponding to the outline of said support plate and is applied to this plate in such a manner as to adhere both to the plate and to the seals of the said two pots;

a tongue extending from one portion of the boundary of the adhesive label, said tongue having an adhesive face and being separable from the said label by tearing; and a flexible flat container which can be torn open and contains a small spoon, said container being carried by the said tongue due to adhesion between the adhesive face of the tongue and the container.

2. A pack according to claim 1, wherein said tongue is formed in a single piece with the said adhesive label, a series of aligned perforations being provided along the boundary between the label and the tongue to enable the tongue, with the spoon container attached, to be torn off from label.

3. A pack according to claim 1, wherein the flange of each said pot is glued at at least some points to the support plate.

4. A pack according to claim 1, wherein the said apertures in the plate have a circular profile and the pots each have a cylindrical side wall.

5. A pack according to claim 4, wherein the said support plate is elongate in form and has an outline comprising two parallel straightline sides connected by two semicircular sections which have the same centre of curvature as the said two apertures.

6. A pack according to claim 5, wherein the part of the support plate which is comprised between the said two apertures is provided with reinforcing ribs.

7. A pack according to claim 6, wherein the tops of at least one part of the reinforcing ribs of said support plate lie in the same plane as contains the said seals closing the two pots.

8. A pack according to claim 1, wherein the support plate is made of heat moulded plastic material.

9. A pack according to claim 1, wherein the two pots are made of heat moulded plastic material.

10. A pack according to claim 1, wherein the said flange of each pot is formed with an annular groove in its upper face.

11. A pack according to claim 10, wherein the said seal which closes the mouth of each said pot is of aluminium foil and is stuck on the flange of the pot in such a manner that it also adheres to the walls of the said annular groove formed in the flange.

12. A pack according to any one of the preceding claims, wherein one said pot contains a cream product, and the other said pot contains puffed cereals.

* * * * *